US006023955A

United States Patent [19]

Grondahl

[11] Patent Number: 6,023,955

[45] Date of Patent: Feb. 15, 2000

[54] DEVICE FOR THE BENDING OF SPRINGS FOR SPRING INTERIOR MATTRESSES

[75] Inventor: Sven Algot Grondahl, Stockholm, Sweden

[73] Assignee: Lema Industrial Ltd., Dublin, Ireland

[21] Appl. No.: 09/155,329

[22] PCT Filed: Jan. 22, 1998

[86] PCT No.: PCT/SE98/00092

§ 371 Date: Oct. 30, 1998

§ 102(e) Date: Oct. 30, 1998

[87] PCT Pub. No.: WO98/32555

PCT Pub. Date: Jul. 30, 1998

[30] Foreign Application Priority Data

Jan. 27, 1997 [SE] Sweden ..... 9700223

[51] Int. Cl.[7] ..... B21F 3/10; B21F 3/04

[52] U.S. Cl. ..... 72/138; 72/145

[58] Field of Search ..... 72/129, 135, 137, 72/138, 140, 145, 142; 140/3 CA, 102, 103

[56] References Cited

U.S. PATENT DOCUMENTS

| | | | |
|---|---|---|---|
| 4,112,726 | 9/1978 | Adams et al. | 72/137 |
| 4,682,394 | 7/1987 | Well et al. | 72/138 |
| 4,713,956 | 12/1987 | Sasaki et al. | 72/137 |
| 5,099,669 | 3/1992 | Del Fabro | 72/307 |
| 5,363,681 | 11/1994 | Speck et al. | 72/137 |
| 5,444,905 | 8/1995 | St. Clair | 72/138 |

FOREIGN PATENT DOCUMENTS

WO 81/00974 4/1981 WIPO .

*Primary Examiner*—Joseph J. Hail, III
*Assistant Examiner*—Rodney Butler
*Attorney, Agent, or Firm*—Young & Thompson

[57] ABSTRACT

A device for the manufacture of elastic springs for spring interior mattresses, vehicle cushions, cushions and the like. The springs are constructed from a row of continuous, spiral shaped parts arranged after each other. The device comprises a feeding tool (18) for the spring wire (6), a bending tool (20) for the wire adjustable in a plane essentially perpendicular to the feed direction of the wire, and a spring shaping tool (21), which can consist of two parallel plates between which the wire runs during the manufacturing of the spiral shaped parts of the elastic spring and which are turnable for the adjustment of the slope angle of the spring part. At least one gear transmission (22), which especially can be a planetary transmission, is arranged for the adjustment of the spring shaping tool (21) in predetermined rotational positions. The adjustment tools (21, 42) are arranged for on the one hand the adjustment of the angular position of the bending tool (20), and on the other hand for the performance of the predetermined bending operations.

5 Claims, 6 Drawing Sheets

DEVICE FOR THE BENDING OF SPRINGS FOR SPRING INTERIOR MATTRESSES

FIELD OF THE INVENTION

The present invention relates to a device for manufacturing elastic springs, especially for spring interior mattresses, which springs are constructed from a row of continuous, spiral shaped parts arranged after each other. The device comprises a feeding tool for feeding a spring wire, a bending tool for bending the wire fed by the feeding tool, the bending tool being rotatably adjustable in a plane essentially perpendicular to the feeding direction of the wire, and a spring shaping tool comprising two parallel plates between which the wire is feedable, for producing the spiral shaped parts, which spring shaping tool is rotatably adjustable for adjustment of a slope angle of the spring parts.

BACKGROUND OF THE INVENTION

A previously known device for manufacturing of such elastic springs comprises a machine where the different constituent parts such as the bending tool and the spring shaping tool are controlled through a complicated system of cams and lifters. Such a device has a complex construction and because of all the constituent parts is not completely reliable in function.

SUMMARY OF THE INVENTION

The object with the present invention is to provide a device of the type mentioned in the introduction, which through a simplification of the constituent units can make it possible in a simpler way to adjust different parameters in order to obtain elastic spring coils with predetermined desired variable dimensions.

The object is achieved according to the invention through a device which has at least one gear transmission arranged for setting the spring shaping tool in predetermined rotational positions, and adjustment tools arranged for adjustment of the angular position of the bending tool, and for the performance of predetermined bending operations.

The preferred embodiments of the invention have the characteristics which are evident from the dependent claims.

Through such a device it is possible to easily, either manually or through pre-programming, change the completed elastic spring's dimensions concerning both size and integral spring forces. This should be able to be carried out in order to manufacture mattresses with individual integral characteristics. Every person can therefore with such a device according to the invention very easily obtain a tailor made mattress which takes account of, amongst others, height and body shape.

BRIEF DESCRIPTION OF THE DRAWINGS

The invention will be described more closely in the following with reference to the accompanying drawings which show a preferred embodiment.

FIG. 1A shows a cross-section through the spring in FIG. 1C along line a—a, and where

DETAILED DESCRIPTION OF THE INVENTION

Figure 1A:
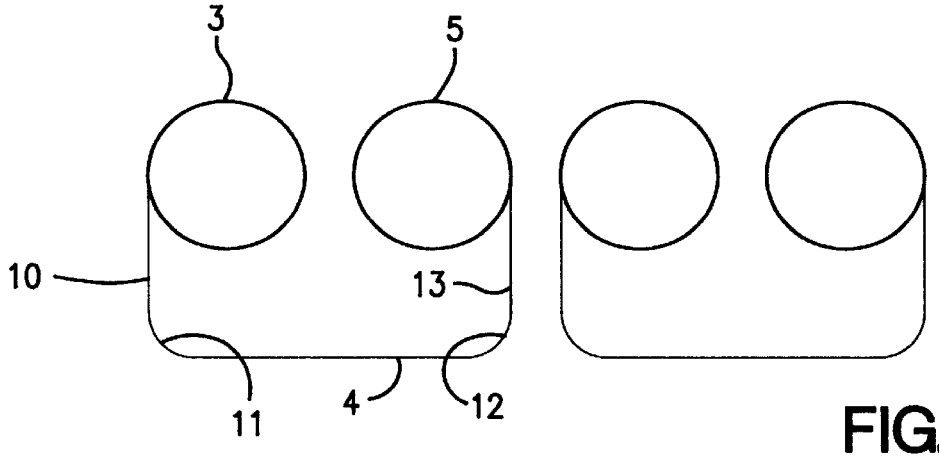
FIGS. 1A, B and C show a finished bent and manufactured elastic spring for a spring interior mattress, where
Figure 1B:
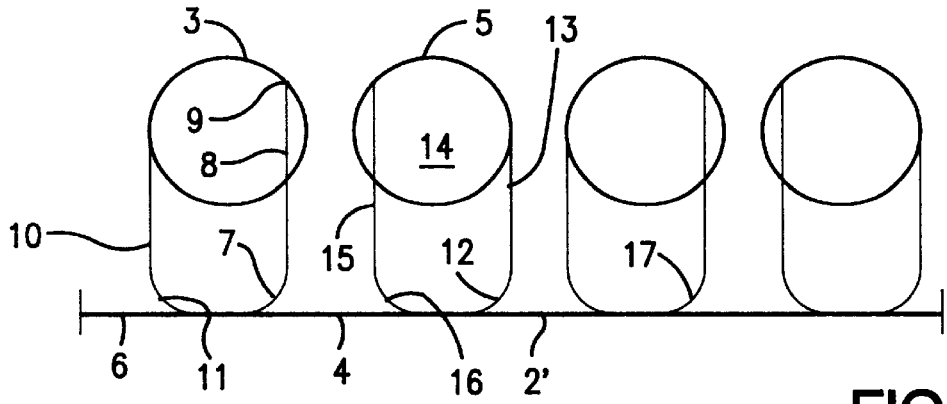
FIG. 1B shows a cross-section of the elastic spring in FIG. 1C along line b—b.
Figure 1C:
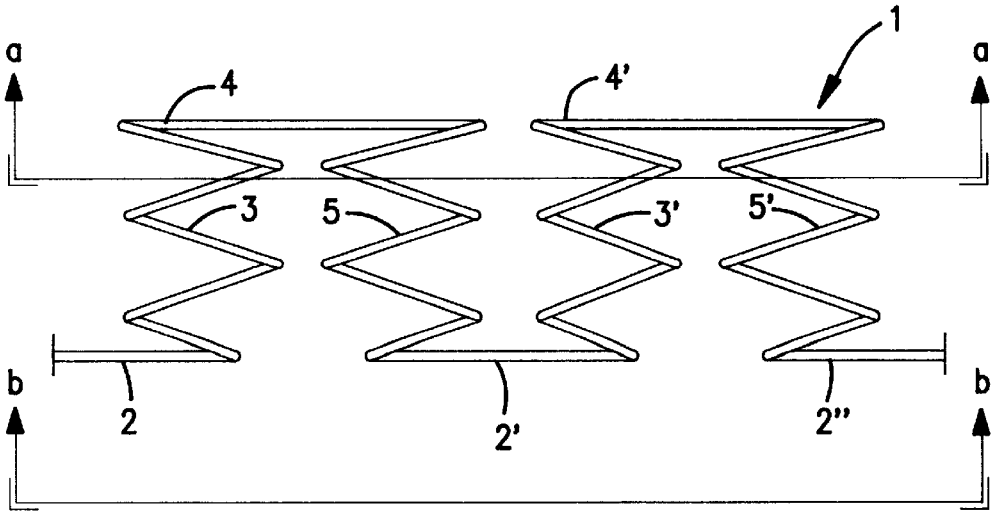
FIG. 1C shows the finished spring from the side, where

FIGS. 1A–C show a finished spring, more closely defined a part of an elastic spring 1, which is included as one of several similar rows of springs in a bed mattress. The elastic springs 1 have a straight part 2, a first spiral shaped part 3, a further straight part 4, a second spiral shaped part 5 and further a straight part 2' corresponding to the straight part 2. FIG. 1B shows how the spring wire 6 is itself bent between the spiral shaped parts in order to provide a row of continuous, spiral shaped parts arranged after each other. The wire first follows the straight part 2 and is then bent at 7 in order to again, after straight part 8, be bent on the other side at 9, whereafter the spiral shaped part 3 begins. After a continuation tangentially out from the spiral shaped part a straight part 10 is connected. Thereafter, after a bending at 11 the straight part 4 starts and after the straight part 4 the wire is again bent at 12 in order to, after a straight part 13, go over to the spiral shaped part 5. At the end of this part the wire is once again bent at 14 whereafter a straight part 15 is produced which after a bending at 16 goes over into the straight part 2'. The series of event starts then again with a bending at 17 which corresponds to the bending 7 before the first spiral shaped part 3. The bending 17 is the beginning of the spiral shaped part 3' in FIG. 1C.

In FIG. 1A the bending at the end of the spiral shaped parts, that is to say at the straight part 4, is illustrated.

By means of the device according to the invention it is possible through programming of a control unit to manufacture an elastic spring with matching spiral shaped parts and straight parts. Such programming of, for example, the length of the straight parts 2, 4, 10, 8, 15 and 13 takes place through stating when the bending operation shall be performed, and which slope, width and length the next spiral shaped part shall have by a predetermined feed speed of the wire.

Figure 2:
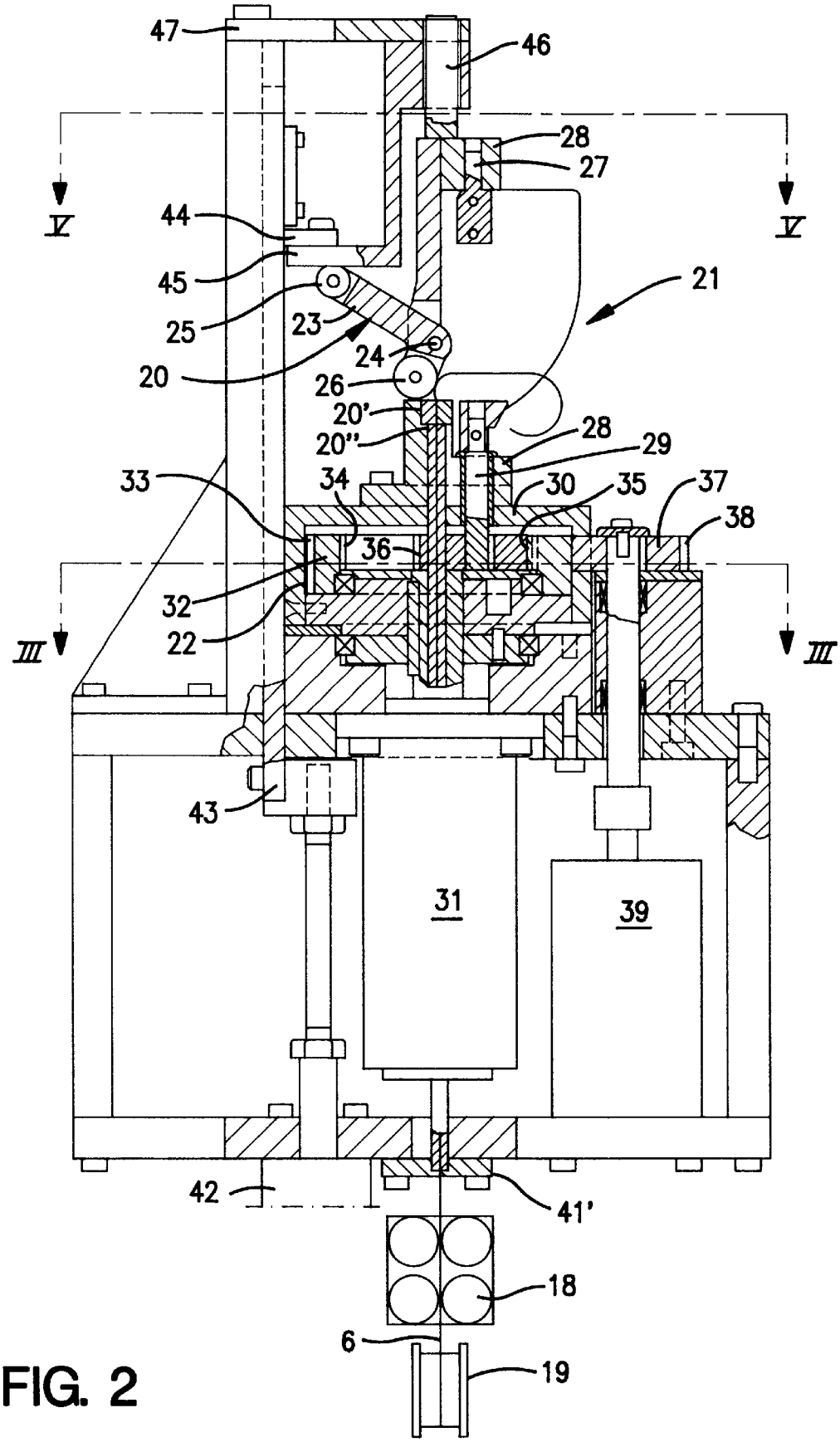
FIG. 2 shows a partially sectioned lateral view of a device according to the invention.

FIG. 2 shows a device according to the invention for the manufacturing of an elastic spring of the type which, for example, is shown in FIGS. 1A–C. The spring wire 6 is fed by means of a feeding tool 18 suitably consisting of a number of rollers, wherein at least one is driven. The spring wire is stored on a bobbin 19 for feeding through feeding tool 18 and up through the device for the production of an elastic spring. The device comprises a bending tool 20, bucking tools 20' and 20", a spring shaping tool 21 for manufacturing the spiral shaped part of the elastic spring, and a gear transmission unit 22 for controlling the tools comprised in the device.

The bending tool 20 consists of an essentially L-shaped arm 23 which is mounted in bearings at a point 24 on the bracket 28. A first roller 25 is mounted in bearings at the end of the longer branch of the L-shaped arm 23 and a second roller 26 is mounted in bearings at the end of the shorter branch of the L-shaped arm 23. The bucking tools 20' and 20" are fixed on the bracket 28.

Figure 5:
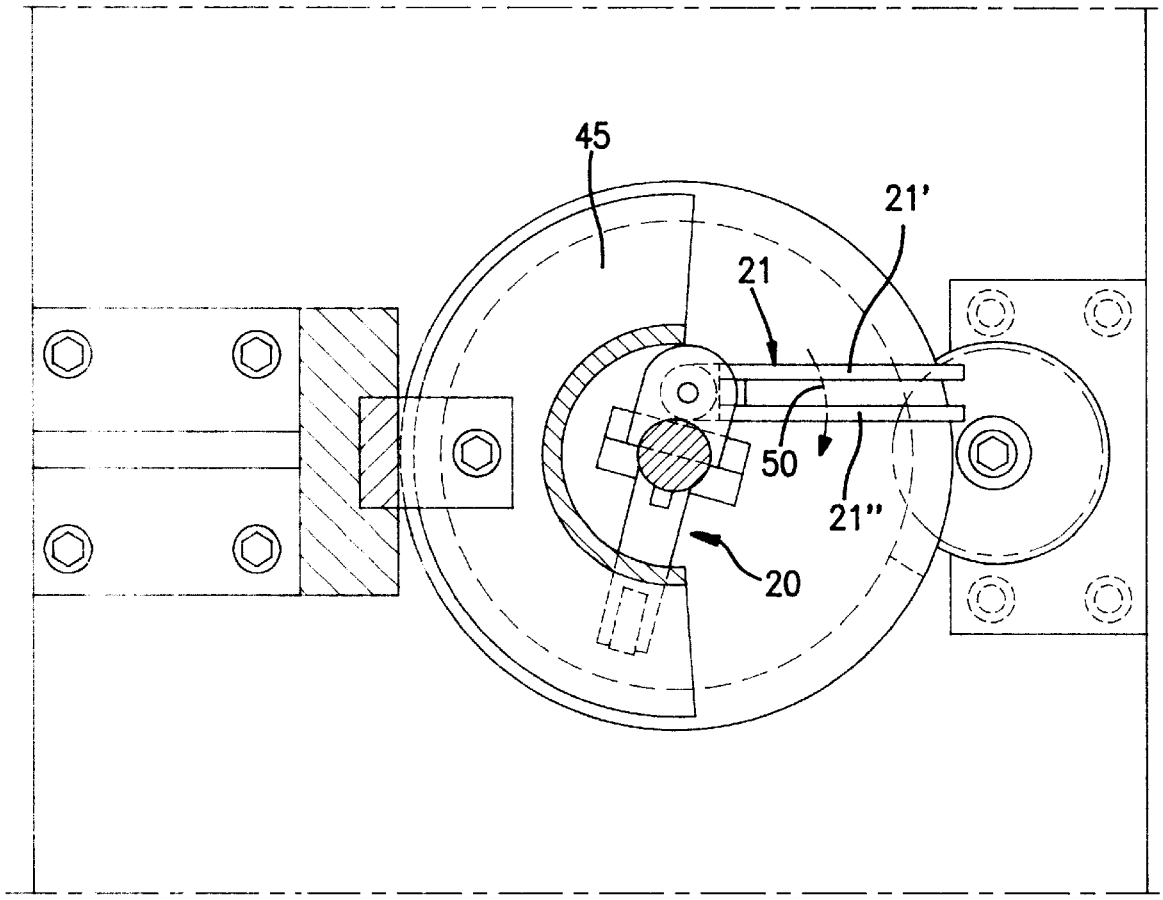
FIG. 5 shows a cross-section along line V—V in FIG. 2, where the spring shaping tool is in a position corresponding to that in FIG. 4.
Figure 6:
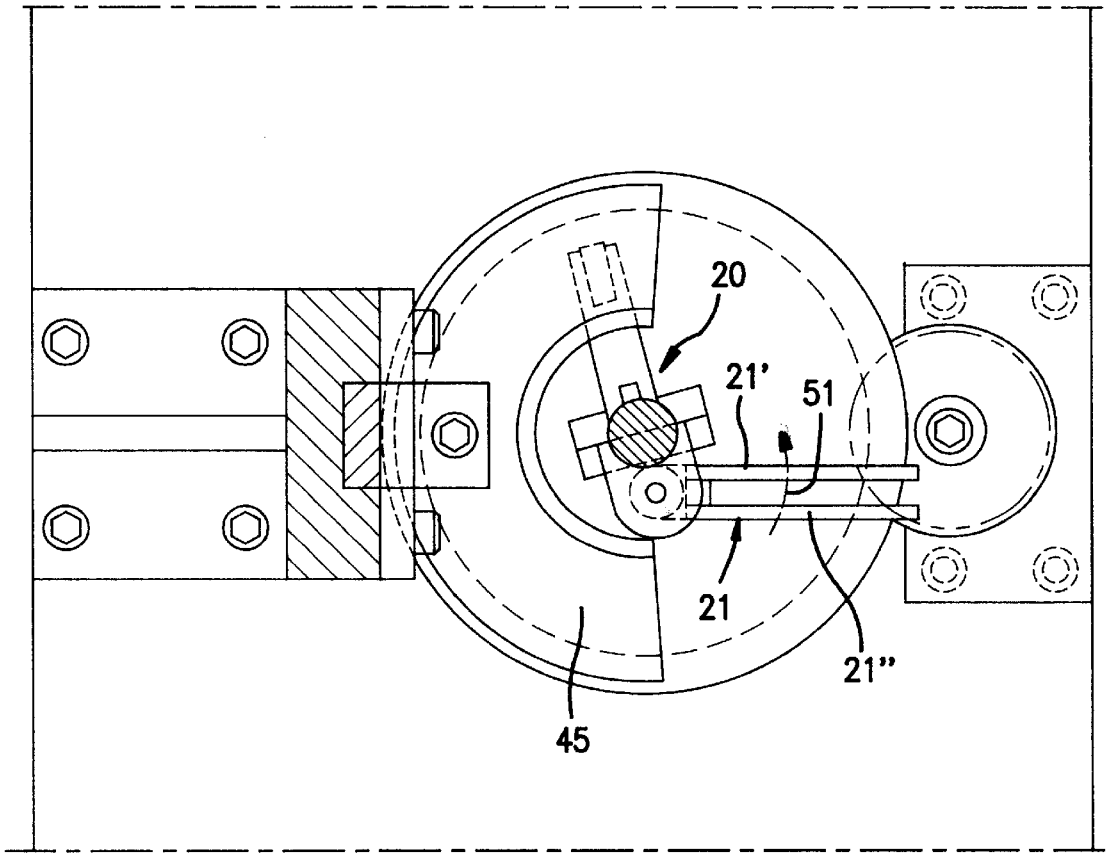
FIG. 6 shows a view similar to FIG. 5, where the spring shaping tool is in a position corresponding to that in FIG. 3.

The spring shaping tool 21 consists of two parallel plates 21', 21" according to FIG. 5 and FIG. 6 which at their upper end are joined to each other by means of a shaft 27 mounted in a hole in a block 28', and are connected with each other at the other end by means of a shaft 29 running through the brace 28. The bracket 28 is attached to a housing 30 surrounding a gear transmission unit 22, the housing being adjustable between two outer positions by means of a rotating cylinder 31.

Figure 3:
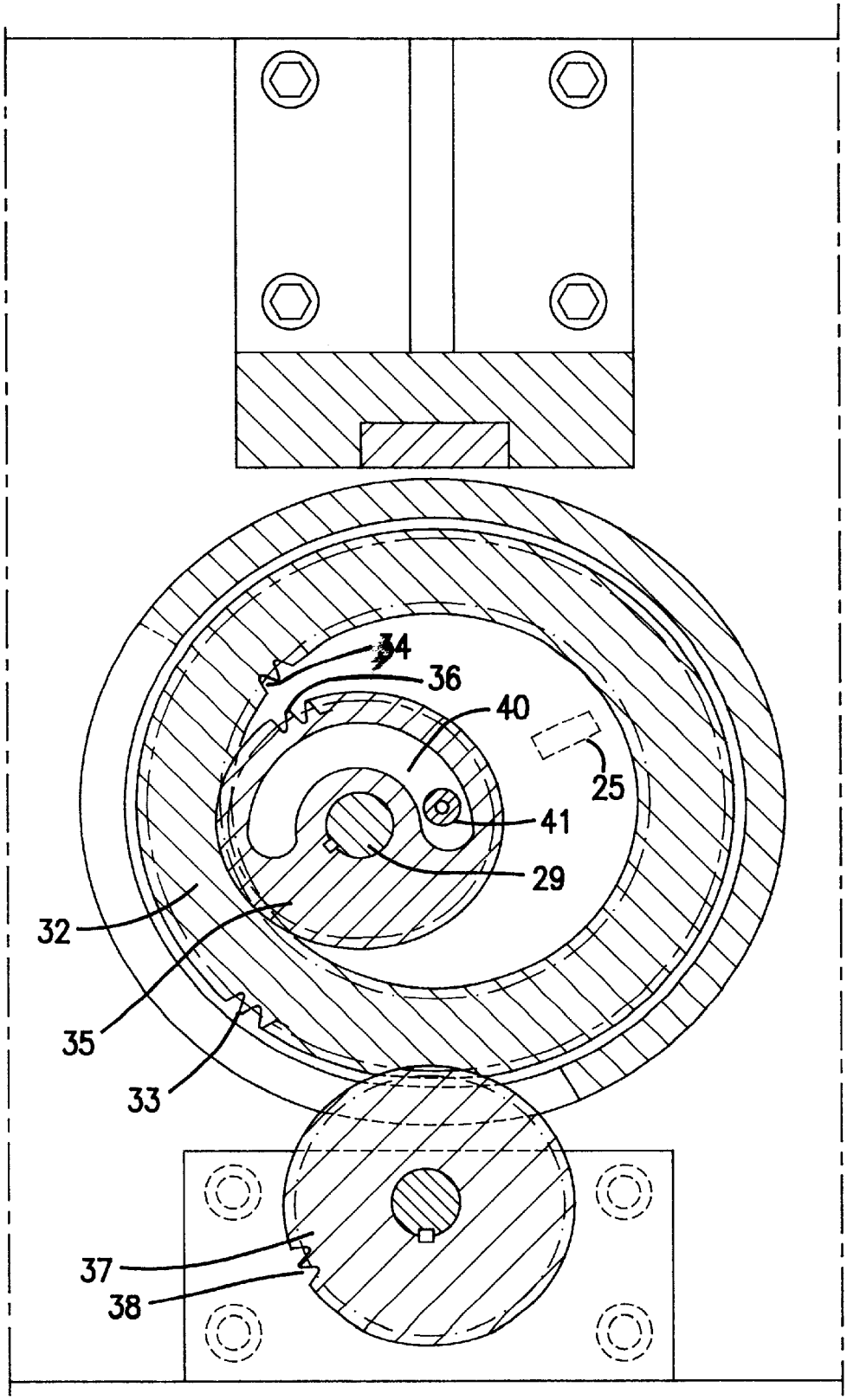
FIG. 3 shows a cross-section along line III—III in FIG. 2, where the spring shaping tool is in a first position.
Figure 4:
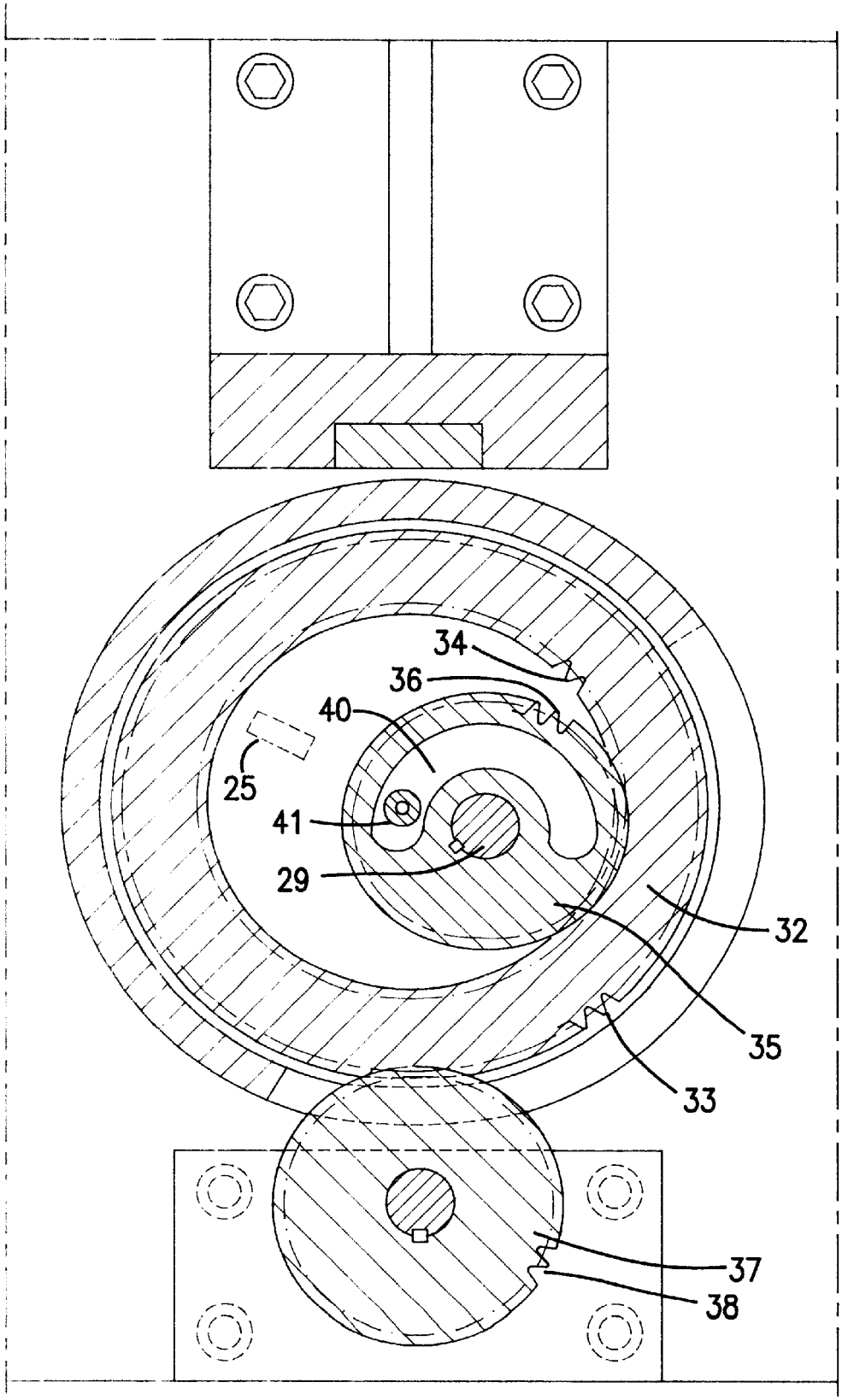
FIG. 4 shows a view similar to FIG. 3, where the spring shaping tool is in a second position.

The gear transmission unit 22 is formed by a planetary transmission with a ring wheel 32 with outer and inner teeth 33 and 34 respectively. The inner teeth 34 of the ring wheel 32 are in mesh with the teeth 36 of a planet wheel 35. The outer teeth 33 are in mesh with the teeth 38 of an adjustment wheel 37. The adjustment wheel 37 is driven by a reversible stepping motor 39. The planet wheel has, at a distance from its central axis, an essentially semicircular shaped slot 40 through which a tube 41 passes. The movement of the planet wheel 35 from a first end position according to FIG. 3 to a second outer position according to FIG. 4 is realizable through the arrangement of the slot 40. The tube 41 is arranged between a plate 41 equipped with a hole, which is bolted fast in the bottom of the stand, and the bucking tools 20' and 20".

The bending tool 20 is displaceable between an operative position and a non-operative position through the activation of an adjustment 42, which via an arm 43 moves a plate 44 fixed on the arm between different predetermined positions. An elongated part 46 of the block 28' is formed by a shaft which is mounted in bearings in a part 47. The plate 44 influences a semicircular shaped plate 45 mounted in bearings on the block 28' such that when the arm 43 draws down the plate 45 the roll 25 is influenced. The bending tool 20 which is mounted in bearings in the block 28 at 24 then performs a circular movement around the point 24. The roller 26 then loads the wire 6 and bends this with considerable force. The different stroke lengths of the arm 43 determine the appearance of the spring 1 being formed with respect to its bending radius. The patterns of the stroke length are obtained with a sophisticated control system and an adjustment tool preferably in the form of a hydraulic cylinder 42 of a special type.

The roller 26 has an idle position where it is in contact without exterior forces against the wire, and the working position where it presses against the wire with an exterior force produced by means of the adjustment tool 42 and transmitted to the roller 26 via the arm 43, plate 44, roller 25 and the L-shaped hinged arm 23. The wire itself presses the roller 26 in the direction towards the idle position. When the adjustment tool 42 is activated then consequently the wire is deformed owing to the pressure which is produced against it. A weak pressure against the wire gives a large radius and a powerful pressure gives a small radius. Furthermore, the duration acts in such a way that a short duration and a large pressure gives a bending of the wire with a small radius, such as the bendings 11 and 12 in FIG. 1A. A longer duration with lower pressure gives a bending with a larger radius, such as the spiral shaped parts 3 or 5 in FIG. 1A. Naturally both pressure and duration are dependent of the feed speed of the wire by means of the feeding tool 18.

The wire 6 is consequently fed from the bobbin 19 by means of the feeding tool 18 consisting of four rollers up through the channel in the rotating cylinder 31. At the upper end of the channel are the bucking tools 20' and 20" arranged so that the wire can be in contact against them during the influence by means of the deformation roller 26 as explained above.

During the transition from the manufacturing of the one spiral shaped part 3 to the other spiral shaped part 5, which is manufactured in the opposite direction, the bending tool and the spring shaping tool must change position, which takes place in such a way that the rotating cylinder 31 rotates the planet wheel 35 so that the bending tool is moved to the other side of the center space of the ring wheel (see FIGS. 3–6). During movement of the planet wheel 35 it rolls along the inside of and in mesh with the ring wheel. In order that the, plates 21' and 21" on the spring shaping tool 21 shall not bend under during the movement of the planet wheel 35 along the inside of the ring wheel 32 the movement is compensated for by means of the adjustment wheel 37 which meshes with the teeth an the underside of the ring wheel and which are driven by the step motor 39. The plates 21' and 21" during the movement of the planet wheel are directed in substantially the same direction as is evident from FIGS. 5 and 6.

During shaping of the spiral shaped parts of the elastic spring the plates 21' and 21" are rotated to a predetermined position in the direction of the arrows 50 and 51 in FIGS. 5 respectively 6. In this way the slope and springs force of the spiral shaped parts is determined. Consequently it is possible through programming of the control system of the device to obtain elastic spring with different spring forces in a simple and reliable way. By controlling the bending tools, shaping tools and planet gear's movements springs with predetermined appearances and characteristics can be obtained. It is consequently possible to determine in advance the spring constant, length and mutual spacing of each spiral shaped-part comprised in each row of elastic springs. A mattress with transverse elastic springs elements of the type mentioned above can accordingly be given a variation in hardness along its longitudinal direction and if necessary also in the transverse direction The invention is not limited to the above embodiment but can be modified within the scope of the accompanying claims.

I claim:

1. Device for the manufacturing of elastic springs for spring interior mattresses, vehicle cushions or cushions, which springs are constructed from a row of continuous, spiral shaped parts arranged after each other, the device comprising a feeding tool for feeding a spring wire, a bending tool for bending the wire fed by the feeding tool, said bending tool being rotatably adjustable in a plane essentially perpendicular to the feeding direction of the wire, and a spring shaping tool comprising two parallel plates between which the wire is feedable, for producing spiral shaped parts, said spring shaping tool being rotatably adjustable for adjustment of a slope angle of spring parts, wherein at least one gear transmission is arranged for setting the spring shaping tool in predetermined rotational positions, and adjustment tools are arranged for adjustment of the angular position of the bending tool, and for the performance of predetermined bending operations.

2. Device according to claim 1, wherein said gear transmission is a planetary gear.

3. Device according to claim 2, wherein said spring shaping tool is mounted on a planet wheel of the planetary gear, and a ring wheel of the planetary gear, which is in mesh with said planet wheel, is equipped on its outside with teeth for meshing with teeth of an adjustment wheel for adjusting the position of the ring wheel, and thereby also the position of the planet wheel and the spring shaping tool.

4. Device according to claim 3, wherein the feeding tool feeds the spring wire through the adjustment tool, which influences the spring shaping tool, and also feeds the spring wire to the bending tool.

5. Device according to claim 4, wherein the wire is fed to the bending tool through a tube arranged on the adjustment tool, which runs through an essentially semicircular shaped slot in said planet wheel.

* * * * *